US005402721A

United States Patent [19]

Schultz

[11] Patent Number: 5,402,721

[45] Date of Patent: Apr. 4, 1995

[54] VACUUM PRINTING PLATE ROLLER

[75] Inventor: John E. Schultz, Loveland, Ohio

[73] Assignee: Comco Machinery, Inc., Milford, Ohio

[21] Appl. No.: 64,751

[22] Filed: May 13, 1993

[51] Int. Cl.[6] ..... B41F 27/00

[52] U.S. Cl. ..... 101/389.1; 101/382.1

[58] Field of Search ..... 101/389.1, 382.1, 378

[56] References Cited

U.S. PATENT DOCUMENTS

| | | | |
|---|---|---|---|
| 1,858,479 | 7/1929 | Chisholm | 101/382.1 |
| 2,060,082 | 11/1936 | Johnson et al. | 101/378 |
| 3,078,796 | 2/1963 | Kahata et al. | 101/378 |
| 3,146,709 | 9/1964 | Bass et al. | 101/378 |
| 3,353,481 | 11/1967 | Antonucci | 101/389.1 |
| 3,922,772 | 12/1975 | Ericsson | 101/389.1 |
| 4,005,653 | 2/1977 | Arkell | 101/389.1 |
| 4,056,057 | 11/1977 | Smith | 101/389.1 |
| 4,856,428 | 8/1989 | Green et al. | 101/389.1 |
| 5,121,690 | 6/1992 | Yamaguchi et al. | 101/389.1 |

FOREIGN PATENT DOCUMENTS

| | | | |
|---|---|---|---|
| 0095954 | 5/1983 | European Pat. Off. | 101/389.1 |
| 2564781 | 11/1985 | France | 101/378 |
| 2335682 | 7/1973 | Germany | 101/389.1 |
| 0057650 | 12/1911 | Switzerland | 101/378 |
| 2028722 | 8/1979 | United Kingdom | 101/389.1 |

*Primary Examiner*—Edgar S. Burr
*Assistant Examiner*—Anthony H. Nguyen
*Attorney, Agent, or Firm*—Wood, Herron & Evans

[57] ABSTRACT

A printing plate roller including a cylindrical tube and two journaled end caps plugging opened ends of the cylindrical tube, thereby forming a vacuum chamber within the tube. At least one groove is formed in the outer surface of the cylindrical tube with at least one bore hole formed through the wall of the tube interconnecting the at least one groove with the vacuum chamber. It is desirable for a plurality of such grooves to be formed in the outer surface of the cylindrical tube. The vacuum chamber is connectable to a vacuum producing source.

26 Claims, 2 Drawing Sheets

VACUUM PRINTING PLATE ROLLER

FIELD OF THE INVENTION

The present invention relates to a printing plate roller, for use with a rotary printing press, which uses a vacuum to secure a printing plate to the roller, and more particularly to such a printing plate roller for use with a flexographic printing press.

BACKGROUND OF THE INVENTION

There are a variety of ways known for securing a printing plate to the outer surface of a printing plate roller used in a rotary printing press, such as a flexographic printing press. In flexographic printing, for example, the printing plate is flexible, can be easily conformed around the printing plate roller and typically includes a plastic film, such as mylar, mounting a layer of elastomeric material, with an embossed area forming the image to be printed. Such printing plates are often sensitive or structurally weak (i.e., the printing surface is susceptible to damage). One way used to secure such a printing plate is to mount the plate to a backing made of a structurally strong material (e.g., brass) which is formed to fit around but not completely around the plate roller, leaving two ends of the backing with a gap between them. Some form of clamping mechanism is used to secure the backing of the printing plate around the plate roller. The clamps are typically not directly securable to the printing plate without causing damage to the plate. Adhesive systems have also been used to attach the printing plate to the plate roller. Such adhesive systems have included the use of double-sided adhesive tape and spray-on adhesives which have been applied between the outer surface of the plate roller and the back of the printing plate.

Securing the printing plate with clamps requires the use of the backing, which increases costs. In addition, the plate is usually permanently mounted to the backing which limits the possible orientations of the printing plate on the plate roller. Using an adhesive, on the other hand, enables the printing plate to be attached directly to the plate roller without the backing and in a broad range of orientations. However, the use of an adhesive has its own drawbacks. Removal of such an adhered plate may cause the plate to deform, tear or otherwise become damaged, especially if it is a sensitive printing plate. Inconsistencies in the adhesive thickness and the compressibility of the adhesive layer can cause quality problems with the printing process. In addition, removal of the adhesive from the plate roller and printing plate often requires a time consuming and costly cleaning step to remove any adhesive residue.

Another way to secure a printing plate to a printing plate roller is to form a vacuum between the outer surface of the roller and the back of the plate. By using a vacuum to secure the printing plate to the plate roller, the above problems can be avoided. There are a number of prior printing plate roller designs which use a vacuum to secure the printing plate to the roller. However, even with their drawbacks, various clamping and adhesive systems are still being used. It is believed that one reason for the continued use of clamping and adhesive systems is that prior vacuum systems (i.e., the printing plate roller designs) are relatively complex and costly to manufacture.

Therefore, there is a need for a printing plate roller which utilizes a vacuum to secure a printing plate to its outer surface which is relatively simple in construction and inexpensive to manufacture.

SUMMARY OF THE INVENTION

The present invention is directed to a relatively simple and inexpensive printing plate roller which uses a vacuum to secure a printing plate to its outer surface. The present invention cost effectively enables the printing plate to be positioned on the outer surface of the printing plate roller in a variety of orientations. The present invention also enables structurally weak or sensitive printing plates to be secured directly to the plate roller and removed with less risk of being damaged.

In accordance with the present invention, a printing plate roller is provided which includes a cylindrical tube and two journaled end caps plugging open ends of the cylindrical tube, thereby forming a vacuum chamber within the tube. It is desirable to mount a gear to the cylindrical tube for engaging a driving gear in a printing press to rotate the printing plate roller. At least one groove or channel is formed in the outer surface of the cylindrical tube with at least one bore hole formed through the wall of the tube interconnecting the at least one groove with the vacuum chamber. While it is believed that one continuous groove formed around the outer surface of the tube would function adequately, it is desirable for a plurality of grooves to be formed in the cylindrical tube. It has been found cost effective to manufacture the printing plate roller with each of the grooves being formed completely around the circumference of the cylindrical tube and axially spaced apart.

While the journaled end caps can be fixed to the ends of the cylindrical tube in a number of ways, it has been found advantageous to either press fit or shrink fit a plug portion of each end cap into one end of the cylindrical tube. When the cylindrical tube is made of a material like aluminum, it will likely be more desirable to shrink fit than to press fit the end caps in place.

In order to form a vacuum in the vacuum chamber, the vacuum chamber is connectable to a vacuum producing source. It is desirable for a passageway to be formed through at least one of the journaled end caps to provide the vacuum source with access to the vacuum chamber. To facilitate communication between the passageway and the vacuum source, a rotary union is coupled between the passageway and the vacuum source.

Depending, for instance, upon the size and shape of the printing plate, it may be necessary to block or cover up one or more grooves, bore holes or portions of grooves not covered by the printing plate in order to produce a vacuum between the printing plate and the cylindrical tube with sufficient strength to hold the printing plate in position during the use of the printing plate roller in the rotary printing press.

The above and other objectives, features and advantages of the present invention will become further apparent upon consideration of the detailed description and appended drawings.

DETAILED DESCRIPTION OF THE INVENTION

Figure 1:
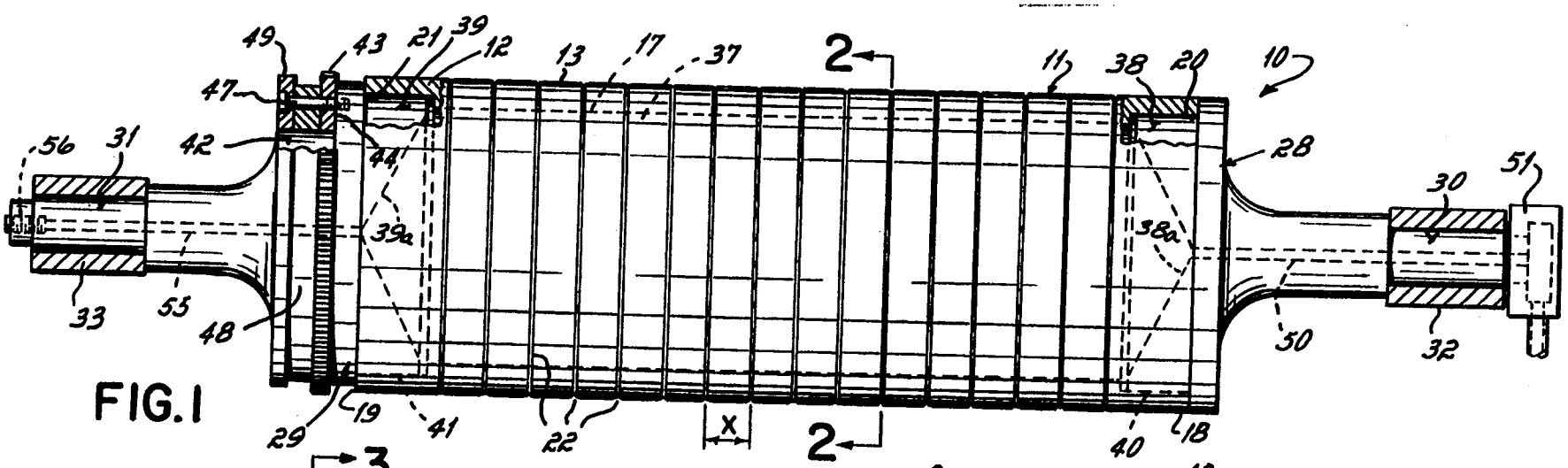
FIG. 1 is a side view of a printing plate roller according to the present invention.
Figure 3:
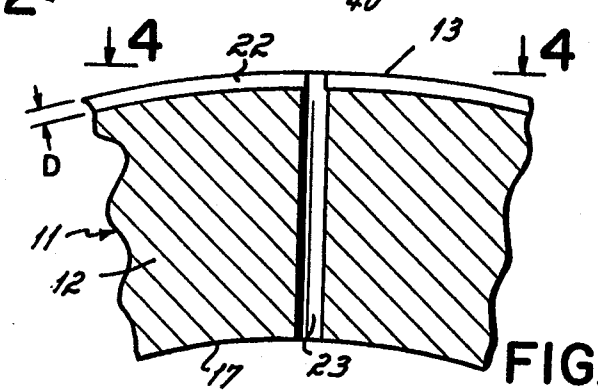
FIG. 3 is an enlargement of the circled area 3—3 of FIG. 2.
Figure 4:
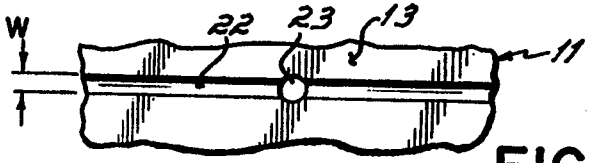
FIG. 4 is a partial view taken along lines 4—4 of FIG. 3.
Figure 2:
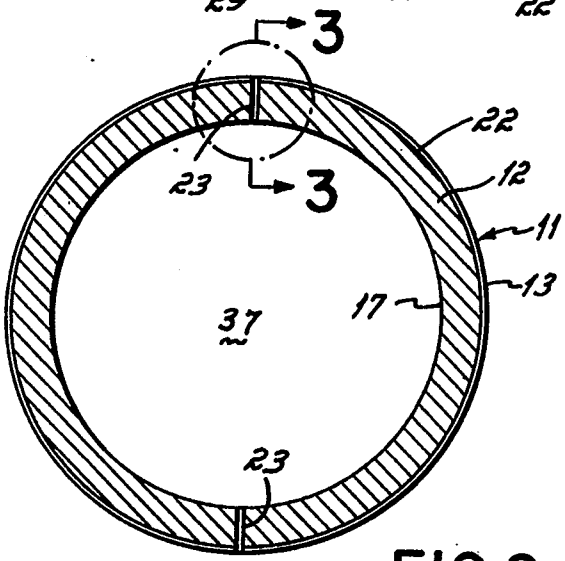
FIG. 2 is an enlarged sectional view taken along lines 2—2 of FIG. 1.

Referring to FIGS. 1–4, one embodiment of a printing plate roller 10 according to the present invention which may be used in a flexographic rotary printing press (not shown). The roller 10 includes a cylindrical tube 11 having a wall 12 with an outer or outside surface 13, an inner or inside surface 17, a first end 18 and a second end 19 with an opening 20 and 21 formed at each of the ends 18 and 19, respectively. A plurality of grooves 22 are formed in the outer surface 13 of the tube 11. At least one and desirably two bore holes 23 are formed radially through the wall 12 interconnecting each of the grooves 22 with the inside surface 17 of the tube 11. It is desirable that the two bore holes 23 for each groove 22 be spaced about 180° apart and be coaxial. It has been found cost effective to form, for example by machining, each of the grooves 22 angularly or circumferentially completely around the outer surface 13 of the tube 11 in an axially spaced apart manner.

The ends 18, 19 of the tube 11 are each plugged with an end cap 28 and 29, respectively. Each of the end caps 28, 29 has a fixed journal portion 30 and 31 integral therewith, rather than a shaft (not shown) passing through each cap 28, 29 and the tube 11. Each of the journal portions 30, 31 is mountable for rotation within a printing press (not shown), for example by fixing a bearing sleeve 32 and 33 to the end of each of the journal portions 30, 31, respectively.

A vacuum chamber 37 is formed inside the roller 10 by the inside surface 17 of the tubular wall 12 and the journaled end caps 28, 29. Each of the end caps 28, 29 has a plug portion 38 and 39, respectively, which is fitted inside of respective openings 20, 21 at the ends 18, 19 of the tube 11. It may be desirable for each of the openings 20, 21 of the tube 11 to have a respective step 40 and 41 in the inside surface 17 for receiving respective plug portions 38, 39 of the end caps 28, 29. The end caps 28, 29 may be fixed to respective ends 18, 19 of the tube 11 by any appropriate method (e.g., welding, press fitting, shrink fitting, etc.) For a tube 11 and end caps 28, 29 made of aluminum or an aluminum alloy, it will likely be desirable to shrink fit the plug portion 38, 39 of each of the end caps 28, 29 in place. For a tube 11 made of 6061 T6 aluminum alloy having: an outside diameter of about 174.473 mm (6.869 inches), an inside diameter of about 139.7 mm (5.5 inches), a length of about 457.2 mm (18 inches) and at each of the steps 40, 41 an inside diameter of about 153.746 mm (6.053 inches), and end caps 28, 29 also made of 6061 T6 aluminum alloy having: plug portions 38, 39 each having an outside diameter of about 154.254 mm (6.070 inches) and sunk into respective ends 18, 19 of the tube 11 to a depth of about 37 mm (1.457 inches), acceptable results have been obtained by heating the aluminum alloy tube 11 to about 204° C. (400° F.), slipping each of the plug portions 38, 39 (unheated) into respective openings 20, 21 of the tube 11 and keeping the end caps 28, 29 in place until the tube 11 has cooled down enough to form a shrink fit around each of the plug portions 38, 29. Satisfactory results have been obtained using steel bearing sleeves 32, 33 with aluminum alloy end caps 28, 29.

A gear 43 is mounted to the tube 11 for being engaged by a drive gear of a printing press (not shown) in order to rotate the printing plate roller 10. End cap 29 has an annular seat 42 for receiving a ring gear 43 which may be removably fixed to the seat 42 by, for example, a plurality of bolts 47 threaded in a flange 44 of end cap 29. If desirable, the ring gear 43 can be mounted on the seat 42 and fixed to flange 44 of end cap 29 by bolts 47 with a retainer ring 48 having an integral bearer ring 49. The gear 43 may be mounted to the tube 11 in this or any other acceptable manner. The design of the gear 43 and whether a bearer ring 49 is used or not may depend, at least in part, upon the type of drive gear used to drive the roller 10.

In order to form a vacuum in the vacuum chamber 37, the vacuum chamber is connectable to a vacuum producing source (not shown). It is desirable for an axial passageway 50 to be bored, or otherwise formed, completely through end cap 28 in order to provide the vacuum chamber 37 with access to the vacuum source (not shown). A rotary union 51 has one end coupled to the passageway 50 with the other end being connectable to the vacuum source so that a vacuum can be formed in the chamber 37 while the roller 10 is rotated.

It may be desirable to grind the outer surface 13 of roller 10, such as by standard finishing techniques, in order to produce a roller 10 having a tube 11 with a highly accurate outside diameter. Such a grinding procedure would typically take place after the end caps 28, 29 have been fixed in place and the grooves 22 have been formed but before bore holes 23 have been formed. To reduce the possibility of the roller 10 cavitating or vibrating during the grinding process, it may be desirable to fill the roller 10 (i.e., vacuum chamber 37) with a dampening fluid (not shown). To aid in the removal of the dampening fluid and, if desirable, in cleaning the inside of roller 10, an axial bore hole 55 can be formed through the other end cap 29. In addition, each inner side of the plug portions 38, 39 may be conically undercut as shown at **38*a* and 39*a* to facilitate removal of the fluid. The undercut also reduces the overall weight of the roller 10. A stopper 56 may then be used to plug hole 55 so that a vacuum may be formed in vacuum chamber 37**.

Figure 5:
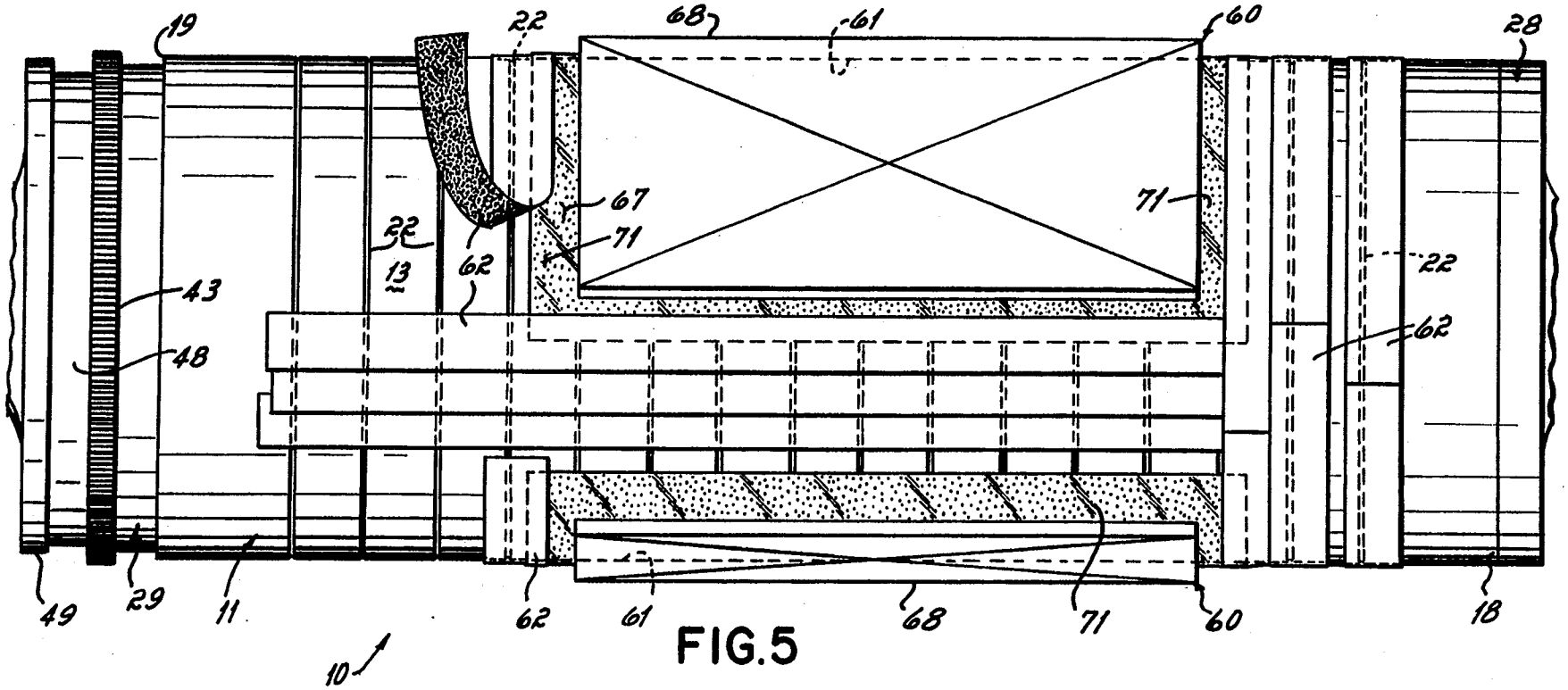
FIG. 5 is an enlarged side view of the printing plate roller of FIG. 1 with a diagrammatic representation of a printing plate attached thereon.

Referring to FIG. 5, in securing a printing plate 60 to the roller 10, a vacuum is produced between the plate 60 and that portion of the outer surface 13 of the tube 11 covered by the plate 60. In order to produce a vacuum with sufficient strength to hold the plate 60 in position on the outer surface 13 during use of the roller 10 in a printing press (not shown), it will likely be necessary to block or cover up any groove 22 (or its bore holes 23) not covered by the printing plate 60 and the uncovered balance of any groove 22 only partially covered by the plate 60. A variety of printing plates 60 may be used, for example, lithographic plates, rotary letter press plates and flexographic printing plates, the later being hereafter described by way of example.

A typical flexographic printing plate 60 has a thin mylar or similar plastic film 61 mounting a layer 67 of an elastomeric material having an embossed or printing area 68 surrounded by a margin or relief area 71. A standard flexographic printing plate, such as that manufactured by E. I. DuPont DeNemours in Wilmington, Del. under the tradename Cyrel, has an overall thickness of about 0.170 mm (0.067 inches). The plastic film 61 is intended to provide at least some protection against distortion or damage to the embossed area 68.

The embossed area 68 is intended to transfer ink or other fluid to a substrate (not shown) during printing. With the present roller 10, most if not all sensitive plates 60 may be directly secured to the outer surface 13 of the tube 11. In fact, the plates 60 are less likely to need the film 61 in order to avoid being damaged (e.g., tearing, stretching, wrinkling, etc.) during attachment and removal thereof.

In securing the printing plate 60 to the roller 10, the plate 60 is positioned onto the outer surface 13 of the tube 11 at a desired location and orientated by any of a variety of well known positioning techniques. For example, mounting jig or pin mounting techniques, well known in the industry, or alignment marks (not shown) on the margin 71 of the layer 67 can be used. After the plate 60 has been properly positioned on the roller 10, lengths of tape 62 may be applied along the margin 71 and over the uncovered outer surface 13 adjacent to the plate 60. FIG. 5 illustrates lengths of tape 62 being applied over the margin 71 and any uncovered grooves 22 or the uncovered balance of any partially covered grooves 22. It is understood that all the grooves are to be covered. Single sided tape 62, such as PVC tape distributed by Spec Tape in Kentucky, part No. ST400C, has been successfully used with typical flexographic printing plates 60 to cover over any uncovered groove 22 or the balance of any partially covered groove 22. No undesirable adhesive residue, which must be cleaned off before a new printing plate can be attached, is usually left behind.

With the outer surface 13 of the tube 11 being covered with tape 62 as previously described, a vacuum of about 635 mm (25 inches) of mercury (12.5 psi) has been found to adequately hold a standard flexographic printing plate 60, such as that previously described. In fact, the following groove 22 configuration has been found to work well in preventing most if not all plastic flexographic printing plates of the type described above, even rubber plates (not shown), from deforming down into the groove when a vacuum of up to at least about 635 mm (25 inches) of mercury (12.5 psi) is produced in the vacuum chamber 37: 16 annular grooves 22, each having a width W of about 0.5 mm, a typical depth D of about 1 mm and adjacent grooves 22 being spaced apart a typical distance X of about 25 mm across a tube 11 of about 457.2 mm (18 inches), with two radial bore holes 23 of about 1 mm in diameter formed 180° apart and coaxially aligned.

The specific roller 10 described herein is particularly applicable to being used in flexographic printing presses (i.e., with flexographic printing plates 60), and even more particularly in narrow web flexographic printing presses. Narrow web flexographic printing presses typically use rollers 10 with tubes 11 having lengths within the range of about 18 inches (457.2 mm) to about 40 inches (1016 mm) and a circumference within the range of about 11 inches (279.4 mm) to about 36 inches (914.4 mm). However, the present invention is not intended to be limited to any particular printing press. It is believed that the principals of the present invention are also applicable to other forms of printing which use printing plates, such as lithographic printing and rotary letter printing by way of example.

From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

What is claimed is:

1. A printing plate roller for use in a rotary printing press, said roller comprising:

a cylindrical tube having a wall, two ends, an outside surface, an inside surface, at least one groove formed in the outer surface of said cylindrical tube, and at least one first bore hole, formed through said wall, interconnecting said at least one groove with the inside of said tube;

two end caps, one of said end caps plugging one end of said cylindrical tube and the other of said end caps plugging the other end of said cylindrical tube, each of said end caps on an outer side including a journal portion integral therewith and at least one of said end caps including an undercut portion on an inner side thereof communicating with a second bore hole extending through said at least one end cap;

a vacuum chamber formed by the inside surface of said cylindrical tube and said end caps; and means for enabling a vacuum to be formed in said vacuum chamber in order to hold a printing plate, positioned to at least partially cover said at least one groove, during the use of said printing plate roller in a rotary printing press.

2. The roller of claim 1, each of said end caps having a plug portion and each of the ends of said cylindrical tube having an opening formed therein for receiving the plug portion of one of said end caps.

3. The roller of claim 2, the plug portion of each of said end caps having been press-fit into the opening at one end of said cylindrical tube.

4. The roller of claim 2, the plug portion of each of said end caps having been shrink-fit into the opening at one of the ends of said cylindrical tube.

5. The roller of claim 4, said cylindrical tube being made of an aluminum alloy.

6. The roller of claim 5, said cylindrical tube being made of a 6061 T6 aluminum alloy.

7. The roller of claim 1, the outer surface of said cylindrical tube having a plurality of grooves formed therein, each of said grooves being interconnected with said vacuum chamber by at least one first bore hole formed through said wall.

8. The roller of claim 7, with a printing plate being positioned to at least partially cover at least one of said grooves, said means for enabling a vacuum to be formed in said vacuum chamber including means for preventing the passage of air through said at least one first bore hole connected to any groove not at least partially covered by the printing plate.

9. The roller of claim 7, with a printing plate being positioned to partially cover at least one groove, said means for enabling a vacuum to be formed in said vacuum chamber including means for covering the balance of said partially covered at least one groove not covered by the printing plate.

10. The roller of claim 7, with a printing plate being positioned to at least partially cover at least one groove, said means for enabling a vacuum to be formed in said vacuum chamber including at least one length of adhesive tape for covering any uncovered groove and the uncovered balance of any groove partially covered by the printing plate.

11. The roller of claim 7, the separation between any two of said plurality of grooves being about 25 mm.

12. The roller of claim 1, said means for enabling a vacuum to be formed in said vacuum chamber including a passageway formed through one of said end caps to provide a vacuum source with access to said vacuum chamber.

13. The roller of claim 12, said means for enabling a vacuum to be formed in said vacuum chamber including a rotary union coupled between the passageway formed through one of said end caps and the vacuum source.

14. The roller of claim 1 said at least one groove having a width of about 0.5 mm.

15. The roller of claim 1, said cylindrical tube having a length within the range of about 18 inches (457.2 mm) to about 40 inches (1016 mm) and a circumference within the range of about 11 inches (279.4 mm) to about 36 inches (914.4 mm).

16. The roller of claim 1, the journal of each of said end caps having a bearing mounted thereon.

17. The roller of claim 1, said cylindrical tube having a gear mounted thereto for engaging a driving gear of a printing press to rotate said printing plate roller.

18. The roller of claim 17, said gear being removably mounted to one of said end caps.

19. The roller of claim 18, said gear being mounted to one of said, end caps with a retainer ring which has a bearer ring integral therewith.

20. The roller of claim 1, wherein said undercut portion is conically shaped.

21. The roller of claim 20, wherein each of said end caps includes an undercut portion on an inner side thereof.

22. The roller of claim 1, wherein said second bore hole extends axially through the journal portion of said at least one end cap.

23. A printing plate roller for use in a rotary printing press, said printing plate roller comprising:

a cylindrical tube having a wall, two end openings, an outside surface, an inside surface, a plurality of axially spaced apart circumferential grooves formed in the outer surface of said cylindrical tube, and at least two first bore holes, formed through said wall, interconnecting each of said circumferential grooves with the inside of said tube;

two end caps, each of said end caps having a plug portion, the plug portion of each of said end caps plugging one end opening of said cylindrical tube, each of said end caps on an outer side including a journal portion integral therewith and at least one of said end caps including an undercut portion on an inner side thereof communicating with a second bore hole extending through said at least one end cap;

a vacuum chamber formed by the inside surface of said cylindrical tube and the plug portions of said end caps;

a gear mounted to said cylindrical tube for engaging a driving gear in a printing press to rotate said printing plate roller; and means for enabling a vacuum to be formed in said vacuum chamber with sufficient strength to hold a printing plate, positioned to at least partially cover at least one of said grooves, during the use of said printing plate roller in a rotatory printing press.

24. The roller of claim 23, wherein said second bore hole extends axially through the journal portion of said at least one end cap.

25. The roller of claim 23, wherein said undercut portion is conically shaped.

26. The roller of claim 25, wherein each of said end caps includes an undercut portion on an inner side thereof.

* * * * *